United States Patent [19]

Fukunaga

[11] Patent Number: 4,717,937

[45] Date of Patent: Jan. 5, 1988

[54] PRESSURE DEVICE OF FIXING ROLLER

[75] Inventor: Takahiro Fukunaga, Nara, Japan

[73] Assignee: Sharp Kabushiki Kaisha, Osaka, Japan

[21] Appl. No.: 787,758

[22] Filed: Oct. 15, 1985

[30] Foreign Application Priority Data

Oct. 15, 1984 [JP] Japan ..... 59-217042
Oct. 15, 1984 [JP] Japan ..... 59-217043

[51] Int. Cl.[4] ..... G03G 15/20
[52] U.S. Cl. ..... 355/3 FU; 430/98
[58] Field of Search ..... 355/3 FU, 3 R, 14 FU; 430/98, 124; 219/216

[56] References Cited

U.S. PATENT DOCUMENTS 4,285,295 8/1981 Iwao et al. ..... 355/3 FU
4,401,385 8/1983 Katayama et al. ..... 355/14 D
4,428,660 1/1984 Matsumoto ..... 355/3 FU

*Primary Examiner*—R. L. Moses
*Attorney, Agent, or Firm*—Birch, Stewart, Kolasch & Birch

[57] ABSTRACT

A device for applying stable pressure to toner fixation rollers of a picture image generation unit comprising: a locking mechanism that divides the picture image generation unit into upper and lower parts, supports the upper part with a shaft so as to allow for its free movement, coupling the upper and lower parts together and applies pressure to the toner fixation rollers.

11 Claims, 7 Drawing Figures

PRESSURE DEVICE OF FIXING ROLLER

BACKGROUND OF THE INVENTION

The present invention relates to a device for applying pressure to toner fixation rollers that fix unstable toner that has been transferred to a copy paper from a picture recording device of an electrophotographic copying machine or laser printer.

A variety of copying machines and laser printers are widely available with picture forming devices based on an electronic photographing system. In general, such an electrophotographic device causes the photoreceptor to be uniformly charged before causing either the draft picture to be exposed to a light source or the recorded information to be converted into optical data. This causes a static latent image to be formed on the photoreceptor by radiating light onto it. Such a latent image formed on the photoreceptor is then visualized by means of a developer unit after the adhesion of color pigment toner onto it. Such a visible image, i.e., toner image, is first transferred onto copy paper and then conveyed to a fixer along with copy paper for fixing the image Conventionally, both pressure and heated fixing methods are well-known. A heated fixer is provided with a pair of rollers which cause toner to be fixed onto the copying paper by means of heating the roller which is in contact with the toner at a constant temperature. The toner fixation system also applies a considerable amount of pressure to the pair of rollers so that the toner image can be stably fixed onto the copy paper by the pressure. Depending on the configuration of either the copy machine or the laser printer, the device may be divided into upper and lower parts along the copy paper transport path, the upper part being supported by a shaft against the lower part so that the upper part can be opened and closed against the lower part. Such a configuration allows misfed paper to be easily removed merely by opening the device. In addition, such a device also has an advantage in that component parts can be easily replaced during maintenance and servicing.

Conventional devices normally apply pressure to a toner fixation roller and release pressure from it by interconnecting the device with an opening and closing mechanism. For example both ends of the upper frame are bent to push the upper toner fixation roller downwards. Spring force is then applied so that it presses against the lower toner fixation roller with an adequate amount of pressure. Consequently, when the upper frame is opened, pressure on the upper toner fixation roller is released, and when the upper frame is closed, an adequate amount of pressure is again applied to the toner fixation roller. Nevertheless, in a device having the configuration mentioned above, the position of the bent portion of the upper frame cannot always be maintained accurately, thus causing a certain differential pressure to be generated in the direction of the shaft of the toner fixation rollers. Likewise, there is a problem with respect to the strength of the bent portion used for applying pressure. This problem is normally caused in applying pressure to the toner fixation roller by using the upper frame itself.

SUMMARY OF THE INVENTION

The present invention provides a device capable of applying stable pressure to the toner fixation rollers, and, in addition, provides a means of easily adjusting the pressure applied to the toner fixation rollers.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those who are skilled in the art.

To achieve the above objects, one of the preferred embodiments of the present invention provides a device for applying stable pressure to the toner fixation rollers of a picture image generation device which form a toner image on copy paper after receiving an adequate amount of pressure. The pressure-applying device is comprised of a locking mechanism that causes the picture image generation device to be divided into upper and lower parts with free movement. Thus, while engaged, the locking mechanism also applies pressure to the toner fixation rollers. Another preferred embodiment of the present invention provides a pressure-adjustment member in part of the locking mechanism.

BRIEF DESCRIPTION OF THE DRAWINGS

The present invention will be better understood from the detailed description given hereinbelow and the accompanying drawings are given by way of illustration only, and thus are not limitative of the present invention and wherein.

DETAILED DESCRIPTION OF THE PREFERRED EMBODIMENTS

Figure 1:
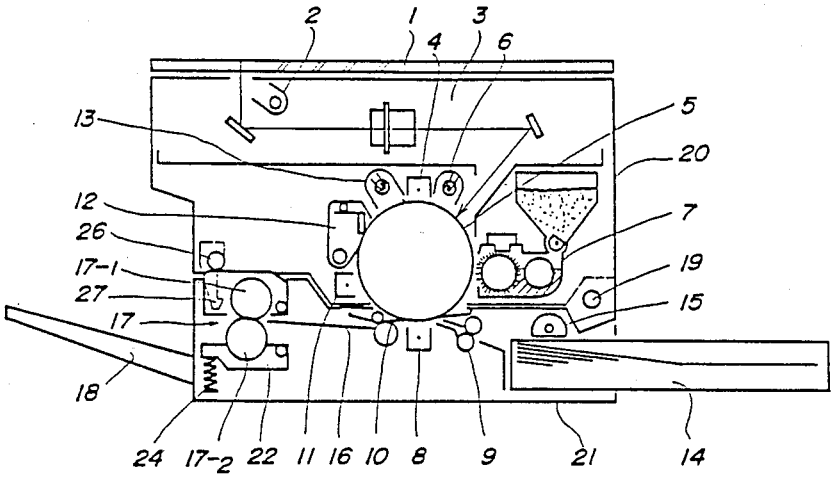
FIG. 1 is the sectional view of an electrophotographic copying machine provided with a toner fixation roller pressurizing device reflecting one of the preferred embodiments of the present invention.

FIG. 1 is a sectional view of an electrophotographic copying machine incorporating a toner fixation roller pressurizing device and is one embodiment of the present invention. Reference number 1 indicates an original document table. Reference number 2 indicates an illuminator that illuminates an original document on the table 1. Reference number 3 indicates an optical system for focusing a reflective optical image on a photoreceptor 5. The optical system 3 is comprised of a mirror and a lens. Reference number 4 indicates a corona discharger that causes the photoreceptor 5 to be uniformly charged with a specific polarity. Reference number 6 indicates an opto-discharger that discharges unnecessary charge from areas of the surface of the photoreceptor 5 where no picture image is present. Reference number 7 indicates a developer unit that causes a static latent image that is formed on the surface of the photoreceptor 5 to be developed by means of color toner after being imaged by the optical system 3. Reference number 8 indicates a corona discharger that causes the image developed on the photoreceptor to be statically transferred onto copying paper being transported by a conveyor roller 9. Reference number 10 indicates a separation means separating the image-developed papers from the surface of the photoreceptor 5. Reference number 11 indicates an AC corona discharger. Reference number 12 indicates a cleaning device that removes residual toner from the surface of the photoreceptor 5, and reference number 13 indicates an illuminator that causes the potential on the surface of the photoreceptor 5 to become uniform by uniformly illuminating it.

Copy paper is stored in a paper-feed cassette 14 before being transported to the image transfer position. The cassette 14 is provided so that it can freely be mounted onto and removed from the paper-feeding part of the copying machine. A paper-feed roller 15 is provided at the cassette-mounted position in order to draw out each piece of copy paper from the cassette. The paper-feed roller 15 delivers each copy paper to the conveyor roller 9 by making a full turn in response to the paper-feed command signal. The conveyor roller 9 then stops the copy paper fed by the paper-feed roller 15 before starting to transport it synchronously with the rotation of the photoreceptor 5 so that the tips of the image generated on the surface of the photoreceptor 5 and the copy paper correctly match at the image transfer position. The copy paper delivered to the image transfer position then receives the actual image, and it is then separated from the photoreceptor 5 by means of separator 10 before being led to toner fixation rollers 17 along a guide 16. Upper and lower rollers 17-1 and 17-2 of the toner fixation rollers 17 are respectively held under an adequate amount of pressure and thermally fix the image on the passing copy paper. After completing the image fixation, the copied paper is then delivered onto a paper-discharge tray 18 projecting outside the copying machine.

Figure 2:
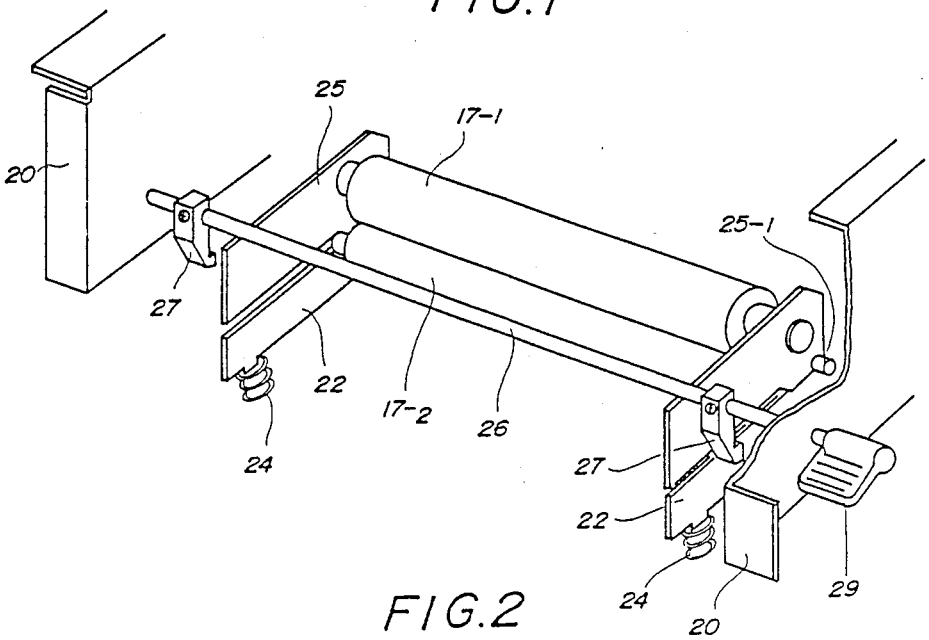
FIG. 2 is the perspective view of the pressure applying device for toner fixation rollers reflecting one of the preferred embodiments of the present invention.
Figure 3:
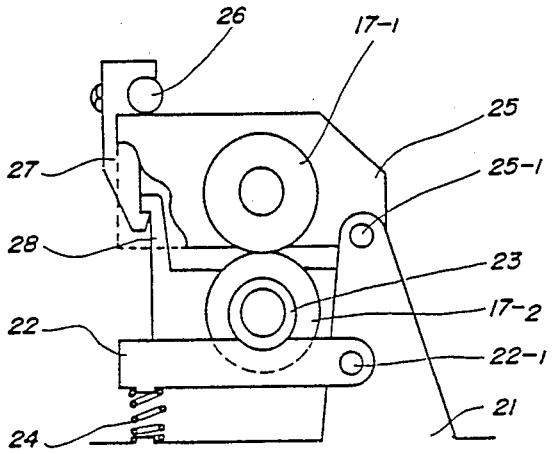
FIG. 3 is the side view of the pressure applying device for toner fixation rollers shown in FIG. 2.

The copy machine itself is divided into two parts along the transport path. The first part delivers copying papers to the image transfer position while the second part delivers them to the tray 18 through the toner fixation rollers 17. Specifically, the copying machine is split into an upper frame 20 and a lower frame 21, while a shaft 19 supports the upper frame 20 against the lower frame 21. The upper frame 20 is provided with an illumination device 2, optical systems 3 and 4, a corona discharger 8, an opto-discharger 6, developer 7, an AC corona discharger 11, a cleaning device 12, and a light radiator 13, respectively. The lower frame is provided with the rest of the component parts including the paper-feeding part of cassette 14, the paper-feed roller 15, a conveyor roller 9, a corona discharger 8, a guide 16 and the toner fixation rollers 17. Consequently, when the upper frame 20 is freed, the copying machine itself is split into the upper and lower parts along the paper transport path to allow the operator easy access to the paper path in case of misfed paper or other malfunctions. While the copying machine remains open, the upper and lower rollers 17-1 and 17-2 of the toner fixation rollers 17 are released from their pressurized state. By referring to FIGS. 2 and 3, the mechanism for pressurizing the toner fixation rollers 17 can be described. The lower roller 17-2 is supported by shaft 22-1 that is in contact with lower frame 21. The shafts on both the right and left sides are ultimately supported by a lower roller support member 22 via bearing 23. The lower roller support member 22 causes the lower roller 17-2 to be pressed upward via spring 24 set between the lower roller support member 22 and the lower frame 21. The freely-rotating upper roller 17-1 is held by an upper roller support member 25 supported by a freely-rotating shaft 25-1 which is, in turn, held by the lower frame 21 that receives the rotating force from the drive source. Conversely, the upper frame 20 is provided with a brace rotating shaft 26 that presses against the upper roller support member 25. The this brace rotating shaft 26 is provided with a screw-fastened brace 27 that connects the upper frame 20 to the lower frame 21. The lower frame 21 is provided with coupler 28 that engages with the brace 27 as shown in FIG. 3. In FIG. 3, in particular, the lock 27 is pressed in the direction of the coupler 28, i.e., counterclockwise, so that it can maintain a satisfactory engagement with the coupler 28. To release the coupled condition, lever 29 is provided at the edge of the rotating shaft 26.

Using such a configuration as is described above, first, the brace 27 in the condition shown in FIG. 3 is rotated clockwise by operating lever 29. As a result, engagement between the brace 27 and the coupler 28 is released and the upper frame 20 is moved upward by means of shaft 19 and a balancing mechanism (not shown) so that upper frame 20 can be held in a balanced position. When the upper frame 20 is opened, the upper roller support member 25 is freed from the state of being pressed down by the brace rotating shaft 26. As a result, the lower roller support member 22 is pushed upward by spring 24, and likewise, the lower roller 17-2 is also pushed upward. The upper roller 17-1 then comes into contact with the lower roller 17-2 because of the weight of upper roller 17-1. Conversely, when the upper frame 20 is closed onto lower frame 21, the upper frame 20 is pushed down so as to resist the force generated by the balancer. When the brace 27 is engaged with the coupler 28 due to a downward motion of the upper frame, the upper frame 20 is then held in position as shown in FIG. 3, thus allowing the copying machine to engage in a copying operation. When this condition is present, the upper roller support member 25 is pushed down by the rotating shaft 26 of the brace 27. As a result, the upper roller 17-1 is pushed down, whereas the lower roller 17-2 orients itself to move upward by means of spring 24, thus eventually generating an adequate amount of pressure between the upper and lower rollers 17-1 and 17-2.

Positions of the upper and lower frames 20 and 21 are determined by both the brace 27 and the coupler 28. The rotary shaft 26 securely fixes the brace 27 and presses support member 25 so as to apply pressure against the toner fixation rollers 17. This allows the copying machine to precisely control the pressurizing operation of the toner fixation rollers 17.

Since the lock mechanism is concurrently used in its pressure applying capacity with respect to the toner fixation rollers 17, the mechanism as designed is both inexpensive and compact. The pressure applying device, one of the preferred embodiments of the present invention, applies pressure to the toner fixation roller using the brace of the picture recording device, which can be divided into the upper and lower units. In addition, since either application or release of pressure is executed by the lock part that determines positions of both the upper and lower divisable units, the system can control the operation with great accuracy. Since the lock mechanism concurrently acts as the pressurizing unit, the system is inexpensive and compact.

Another preferred embodiment of the present invention is described below. Note that the electrophotographic copying machine shown in FIG. 1 also applies to other preferred embodiments of the present invention.

Figure 4:
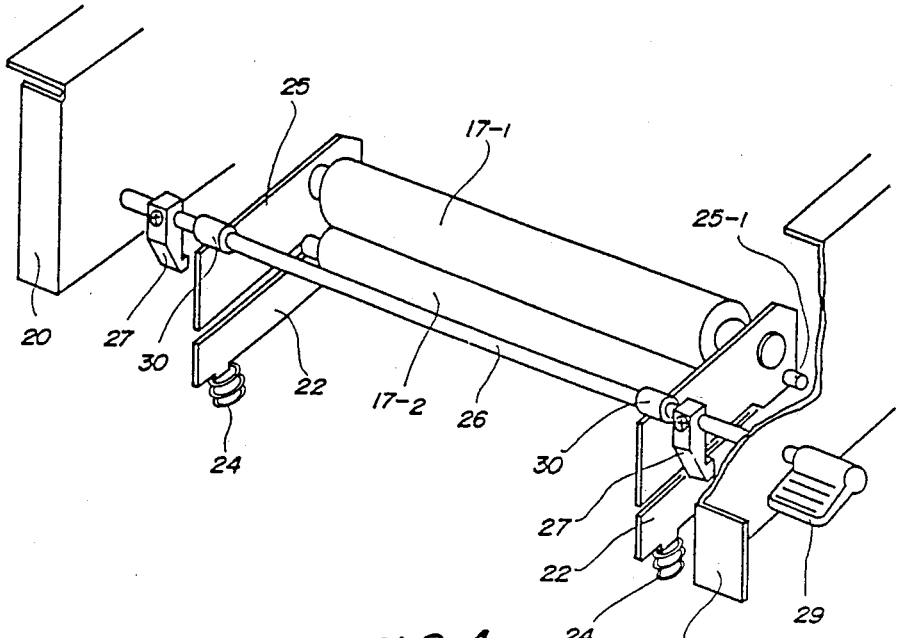
FIG. 4 is the perspective view of the pressure applying device for toner fixation roller incorporating another preferred embodiment of the present invention.
Figure 5:
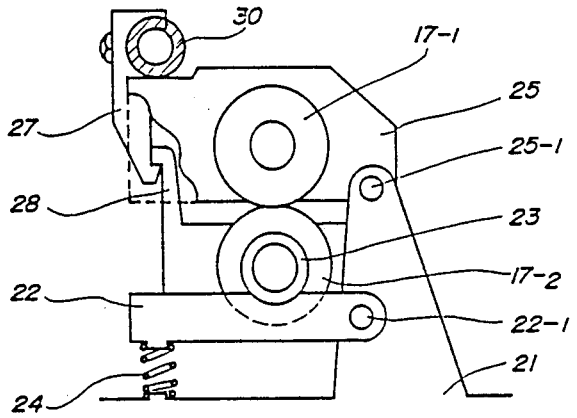
FIG. 5 is the lateral view of the pressure applying device for toner fixation rollers shown in FIG. 4.

Referring now to FIGS. 4 and 5, one of the preferred embodiments of the pressure applying mechanism for the toner fixation rollers 17 is described below. Protrusions from the left and right sides of the lower rollers 17-2 of the toner fixation roller 17 rest on lower roller support member 22 via bearing 23 against the lower frame 21. The lower roller support member 22 causes the lower roller 17-2 to move upward by means of spring 24 set between the lower roller support member 22 and the lower frame 21. The upper roller 17-1 is held by the upper roller support member 25 which is supported by the lower frame 21 so that the upper roller 17-1 can freely rotate, while the rotation force is conveyed from the drive force. Conversely, the upper frame 20 is provided with the rotating shaft 26 that pushes down the upper roller support member 25. Brace 27 connecting the upper frame 20 to the lower frame 21 is secured to the rotating shaft 26 with screws. Coupler 28 shown in FIG. 5 engaging with the brace 27 is attached to the lower frame 21. In FIG. 5, in particular, the brace 27 moves in the direction of the coupler 28, i.e., in the counterclockwise direction, to maintain the engagement with coupler 28. To release the engagement, the lock-release lever 29 is provided at the end of the rotating shaft 26. In addition, the rotating shaft 26 is provided with collar 30 which adjusts pressure applied to the upper and lower rollers 17-1 and 17-2 by pressing down the upper roller support member 25. Collars 30 are provided on the rotating shaft 26 to correctly fit on the upper roller support members 25, and the diameters of these collars 30 can be altered to adjust the pressure of the downward movement.

Using such the configuration described above, the brace 27 in the state shown in FIG. 5 is rotated clockwise by operating lever 29. This releases the engagement between the brace 27 and the coupling 28. As a result the upper frame 20 is moved up by means of shaft 19 (not shown) and a balancing mechanism (also not shown) so that the upper frame 20 is held in a balanced position. When the upper frame is opened, the pressure which was applied to the upper roller support member 25 from the collars 30 on the rotary shaft 26 is released. As a result, the lower roller support member 22 is pushed upward by spring 24, and at the same time, the lower roller 17-2 is also pushed upward. Due to its weight, the upper roller 17-1 then comes into contact with the lower roller 17-2. Conversely, the upper frame 20 may be closed onto the lower frame 21 by applying downward pressure on upper frame 20 to overcome the force of the balancer. As a result, when the brace 27 is engaged with coupler 28, the upper frame 20 is positioned in the state shown in FIG. 5, thus allowing for the copying machine to engage in a copying operation.

Although collar 30 can be fixed to the rotary shaft 26, if it is attached onto the rotary shaft 26 so as to allow free rotation, movement of the rotary shaft 26 by means of lever 29 can be accomplished more easily allowing for a smooth release of the engagement between the brace 27 and the coupler 28. When using the pressure applying mechanism shown in FIG. 4, collar 30 can be replaced with a graduated series of collars for properly adjusting the applicable pressure.

Figure 6:
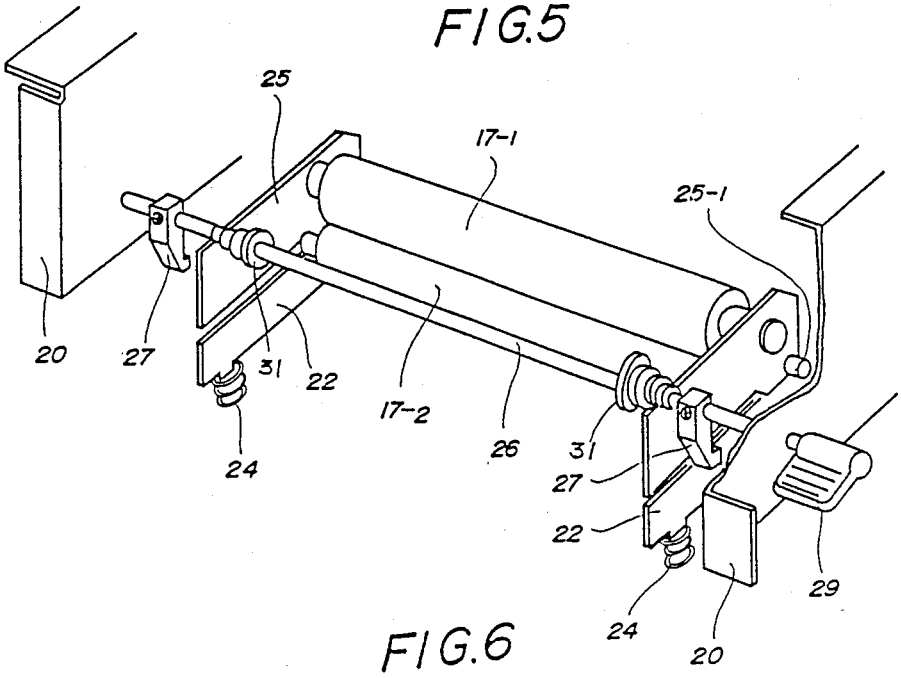
FIGS. 6 and 7 are respectively the perspective views of the toner fixation rollers pressurizing devices representing still further preferred embodiments of the present invention.

A still further preferred embodiment of the present invention comprises a plurality of collars 31 having diameters different from each other, as shown in FIG. 6, all of which are secured to the rotary shaft 26. This configuration allows for easy adjustment of the applicable pressure. In this preferred embodiment, those step portions of respective collars 31 allowing pressure to be uniformly applied in the direction of shaft of roller 17 may be secured to the rotary shaft 26 in a specific relationship with the upper roller support member 25.

Figure 7:
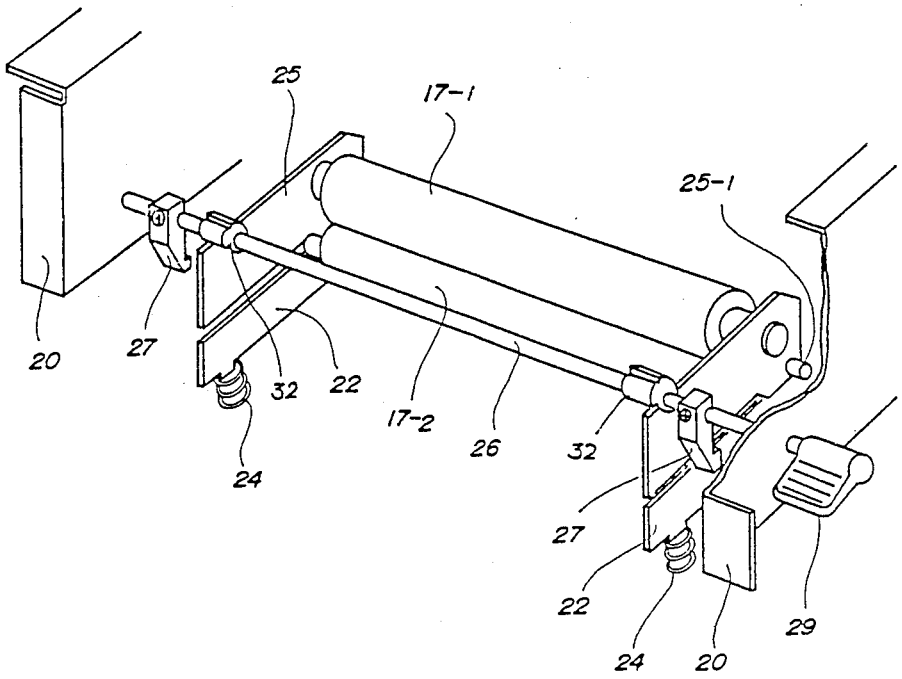

Likewise, independent of the above configuration, a cam 32 having different diameters may also be secured to the rotary shaft 26 as shown in FIG. 7. In this case, cam 32 may be secured to rotary shaft 26 in a specific relationship with the upper roller support member 25. Additionally, a specially designed cam which is eccentric against the rotary shaft 26 may also be attached to the upper roller support member 25. This configuration provides a still higher precision of the pressure adjustment. In this configuration, the upper roller support member 25 is pressed downward by those collars attached to the rotary shaft 26 securing the brace 27. As a result, the upper roller 17-1 presses the lower roller 17-2 downward, while the lower roller 17-2 is pressed upward by spring 24, thus eventually generating an optimum pressure between the upper end lower roller 17-1 and 17-2. The positions of the upper and lower frames 20 and 21 can be set by both the brace 27 and the coupler 28. The rotary shaft 26, securing the brace 27, then presses the upper roller (17-1) support member 25 downward and applies pressure to the toner fixation roller, thus allowing the system to control the pressuring operation with respect to the toner fixation rollers 17 with the utmost accuracy. In addition, since the lock mechanism is concurrently made available for applying pressure to the toner fixation rollers 17, the entire system can be inexpensively and compactly designed. Furthermore, such pressure against the toner fixation rollers 17 can be adjusted in the direction of shaft so that it remains constant by employing a plurality of diameters for collars 30.

A further preferred embodiment of the present invention comprises a configuration of a pressure applying device for toner fixation rollers, in which a pressure adjusting member is installed on the brace of the picture image generating device. This device can be split into upper and lower units, for properly adjusting toner fixation roller pressure. The lock part that determines the positions of the upper and lower units causes pressure to be applied to and released from the toner fixation rollers 17. As a result, the pressurizing operation can be precisely controlled. In addition, since the lock mechanism concurrently functions by applying pressure to the toner fixation rollers, the system can be inexpensively and compactly designed. Since a pressure adjustment member is conveniently provided, pressure can be easily adjusted to an optimum level.

While only certain embodiments of the present invention have been described, it will be apparent to those skilled in the art that various changes and modifications may be made therein without departing from the spirit and scope of the present invention as claimed.

What is claimed is:

1. A device for applying pressure to toner fixation rollers of a picture image generation unit comprising:

a locking mechanism that divides a picture image generation unit into upper and lower frames, supports said upper frame with a hinge shaft means so as to allow for free movement of said upper frame, couples said upper and lower frames together and applies pressure to upper and lower toner fixation rollers of said picture image generation unit when said upper and lower frames are coupled together, wherein said locking mechanism includes a cylindrical pressure shaft means for applying pressure on said upper toner fixation roller and a spring means for applying pressure to said lower toner fixation roller.

2. The pressure device as in claim 1, wherein part of said locking mechanism is provided with a member for adjusting applicable pressure.

3. The pressure device as in claim 1, wherein said picture generation device is incorporated in either an electronic photographic copying machine or a laser printer.

4. A picture generation unit including a system for applying pressure to toner fixation rollers of said picture image generation unit comprising:

a picture generation unit that comprises upper and lower frames;

an upper toner fixation roller supported by an upper roller support member that is in turn supported by said lower frame;

a lower toner fixation roller supported by a lower roller support member that is in turn supported by said lower frame;

an interconnecting means for interconnecting said upper and lower frames so that said upper toner fixation roller and said upper roller support member may be moved adjacent to and away from said lower toner fixation roller and said lower roller support member;

a pressure shaft means for applying pressure to said upper roller support member and thereby to said upper toner fixation roller, said pressure shaft means being supported by said upper frame;

a spring means for applying pressure to said lower roller support member and thereby to said lower toner fixation roller, said spring means being supported by said lower frame; and a coupling means for coupling said upper and lower toner fixation rollers and thereby coupling said upper and lower frames which comprises an upper brace means supported by said upper frame and a lower coupler means supported by said lower frame wherein said upper brace means and said lower coupler means may be coupled together.

5. A picture generation unit as in claim 4, wherein said coupling means is supported by said pressure shaft means.

6. A picture generation unit as in claim 5, wherein said interconnecting means comprises a first hinge shaft for supporting said upper frame and a second hinge shaft for supporting said lower roller support member, said first and second hinge shafts being supported by said lower frame.

7. A picture generation unit as in claim 4, wherein said pressure shaft means is a cylinder.

8. A picture generation unit as in claim 7, additionally comprising a release lever means for rotating said pressure shaft means so as to couple or uncouple said coupling means.

9. A picture generation unit as in claim 8, additionally comprising a collar means for adjusting the pressure applied by said pressure shaft means to said upper roller support member, said collar means being fitted on to said pressure shaft means so as to be disposed between said pressure shaft means and said upper roller support member.

10. A picture generation unit as in claim 9, wherein said collar means comprises adjacent hollow cylinders with identical inner diameters and varying outer diameters.

11. A picture generation unit as in claim 9, wherein said collar means comprises a hollow cam means.

* * * * *